US006662587B2

(12) United States Patent
Rembold et al.

(10) Patent No.: US 6,662,587 B2
(45) Date of Patent: Dec. 16, 2003

(54) AC AND HP SERVICE VALVES FOR MANUFACTURED HOUSING

(75) Inventors: Thomas K. Rembold, Danville, IN (US); Ronald G. McFarland, Indianapolis, IN (US); James K. Beerbower, Brownsburg, IN (US)

(73) Assignee: Carrier Corporation, Farmington, CT (US)

( * ) Notice: Subject to any disclaimer, the term of this patent is extended or adjusted under 35 U.S.C. 154(b) by 7 days.

(21) Appl. No.: 09/921,386

(22) Filed: Aug. 2, 2001

(65) Prior Publication Data

US 2003/0192335 A1 Oct. 16, 2003

(51) Int. Cl.[7] ..... F25B 45/00
(52) U.S. Cl. ..... 62/292; 277/609; 277/917
(58) Field of Search ..... 62/292, 149, 77; 137/68.29, 68.3, 68.19, 68.21, 68.27, 68.28; 277/609, 917

(56) References Cited

U.S. PATENT DOCUMENTS 4,184,661 A * 1/1980 Kushner et al. ..... 62/292
5,172,557 A * 12/1992 Hubbell, Jr. ..... 62/292
5,323,808 A * 6/1994 Shimizu ..... 137/594
5,718,119 A * 2/1998 Wakita et al. ..... 62/303
5,999,700 A * 12/1999 Geers ..... 219/386
6,041,818 A * 3/2000 Schadewald et al. .. 137/614.05
6,138,987 A * 10/2000 Lee ..... 62/292
6,305,081 B1 * 10/2001 Beaver ..... 29/890
6,324,854 B1 * 12/2001 Jayanth ..... 165/11.1

* cited by examiner

*Primary Examiner*—William E. Tapolcai
*Assistant Examiner*—Mohammad M. Ali
(74) *Attorney, Agent, or Firm*—Wall Marjama & Bilinski LLP

(57) ABSTRACT

Apparatus for connecting a first pre-charged section of an air conditioning system to refrigerant lines connecting the section to a second section of the system. A service unit is employed to connect each refrigerant line to the pre-charge section which includes a body fabricated from a square or rectangular piece of bar stock. A main channel is formed through the bar stock and one end of the main channels is coupled to a suitable system component in the pre-charged section by a tube. A connector having a penetratable seal is mounted in the opposite end of the channel. The connector has a male fitting that is threaded into a female fitting. One fitting is mounted in the opposite end of the main channel and the other fitting is mounted in the refrigerant line. The seal is ruptured or broken when the male fitting is threaded into the female fitting a sufficient depth to establish a leak proof joint therebetween. A process valve is also mounted on the bar stock body and communicates with the main channel via an auxiliary channel. The process valve is used in the factory to charge refrigerant into the section prior to the section being shipped into the field.

12 Claims, 2 Drawing Sheets

AC AND HP SERVICE VALVES FOR MANUFACTURED HOUSING

FIELD OF THE INVENTION

This invention relates to a service unit for use in an air conditioning system and, in particular, to a service unit that allows a pre-charged section of a split system to be quickly connected into the system after shipment into the field.

BACKGROUND OF THE INVENTION

This invention has specific application in the manufactured home industry in which split air conditioning systems are supplied by the seller as part of the home. A split air conditioning system includes an outdoor section and an indoor section each of which contains a heat exchanger coil. The sections are connected by a pair of refrigerant lines one of which carries liquid refrigerant between the sections and the other of which carries refrigerant vapor. In the case of a heat pump, the role of the refrigerant lines can be reversed in response to the mode of operation that is selected by the user. Heretofore, split systems were shipped into the field in an uncharged condition and as a consequence a good deal of time had to be spent by the installer making the necessary refrigerant line connections as well as charging the system with refrigerant and testing the system for leaks.

SUMMARY OF THE INVENTION

It is, therefore, an object of the present invention to improve split air conditioning systems.

It is a further object of the present invention to provide a split air conditioning system wherein the outdoor section of the system is pre-charged in the factory prior to shipment into the field.

It is a still further object of the present invention to provide a service unit for use in a split air conditioning system that will permit the rapid connection of two pre-charged sections of the system in the field.

Another object of the present invention is to reduce the amount of time needed to install a split air conditioning system in the field.

These and other objects of the present invention are attained in a split air conditioning unit containing an outdoor section and an indoor section that are connected by a pair of refrigerant lines. In the preferred embodiment of the invention, each refrigerant line is connected to a service unit located at the outdoor section. Each unit includes a body member fabricated of a square piece of bar stock. A main channel is bored through opposing sides of the body member and a tube connects one end of the channel to an appropriate line within the outdoor section. A connector is mounted in the other end of the connector for attaching the unit to one of the refrigeration lines. The connector contains a seal that is opened when the connection to the refrigeration line is completed. A process valve for permitting refrigerant to be charged into the outdoor section is also contained within an auxiliary channel that passes through a third wall of the body member and which enters the main channel. The process valve is used to charge the outdoor section of the system in the factory prior to shipment into the field.

BRIEF DESCRIPTION OF THE DRAWINGS

For a better understanding of these and other objects of the present invention reference will be made to the following detailed description of the invention which is to be read in association with the following drawings, wherein.

DETAILED DESCRIPTION OF THE INVENTION

Figure 1:
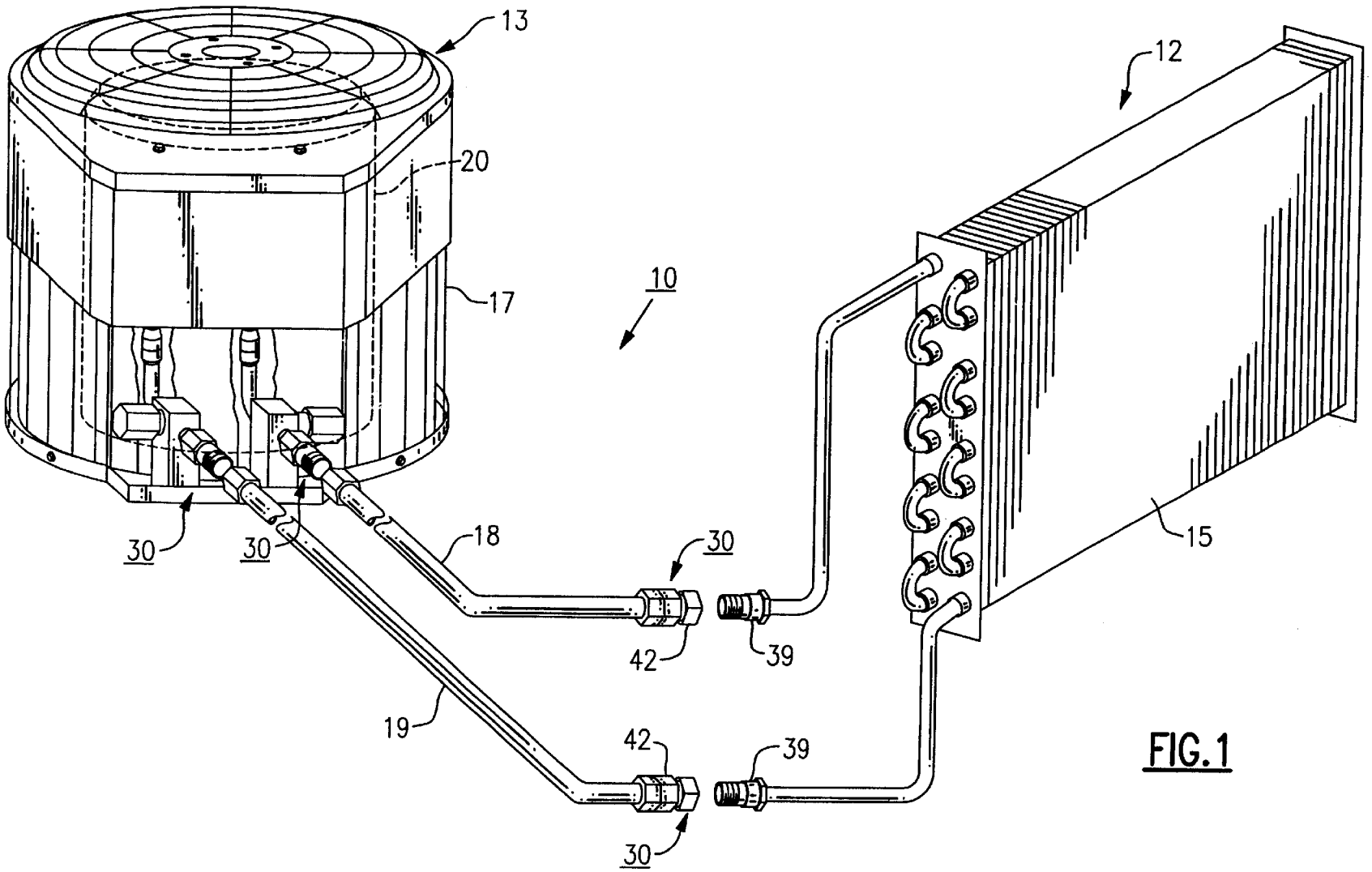
FIG. 1 is a perspective view of a split air conditioning system containing an indoor section and an outdoor section embodying the teachings of the present invention.

Turning now to FIG. 1, there is illustrated an air conditioning system, generally referenced 10, that embodies the teachings of the present invention. The term air conditioning system as herein used relates to a system utilizing a thermodynamic refrigerant cycle for producing either heating or cooling. The present system is a split air conditioning system that employs an indoor section 12 and an outdoor section 13. Each section contains a heat exchanger coil that acts either as a condenser or an evaporator depending on whether the system is operating in a cooling mode or in a heating mode. The coil of the indoor section is identified at 15 while that of the outdoor section is identified at 17.

The two sections of the system are connected in final assembly by means of a line set made up of two refrigerant lines 18 and 19. One of the lines serves as a liquid line for bringing liquid refrigerant from the indoor coil when the indoor coil is acting as a condenser to the outdoor section the coil of which is acting as a condenser to the coil that is acting as an evaporator. The other refrigerant line serves as a vapor line for bringing refrigerant in a vapor state from the coil acting as an evaporator back to the condenser. In this particular embodiment of the invention, a compressor 20 is mounted in the outdoor section for increasing the pressure of refrigerant as it moves between the evaporator and the condenser. Although not shown, a throttling device is also included in the system to expand the refrigerant moving between the condenser and the evaporator thus separating the high pressure side of the system from the low pressure side. In a heat pump embodiment, a four-way valve will also be included for reversing the flow of refrigerant through the system. It should be evident to one skilled in the art that the compressor and throttling device and four-way valve can be located in either of the sections without departing from the teachings of the present invention.

Figure 2:
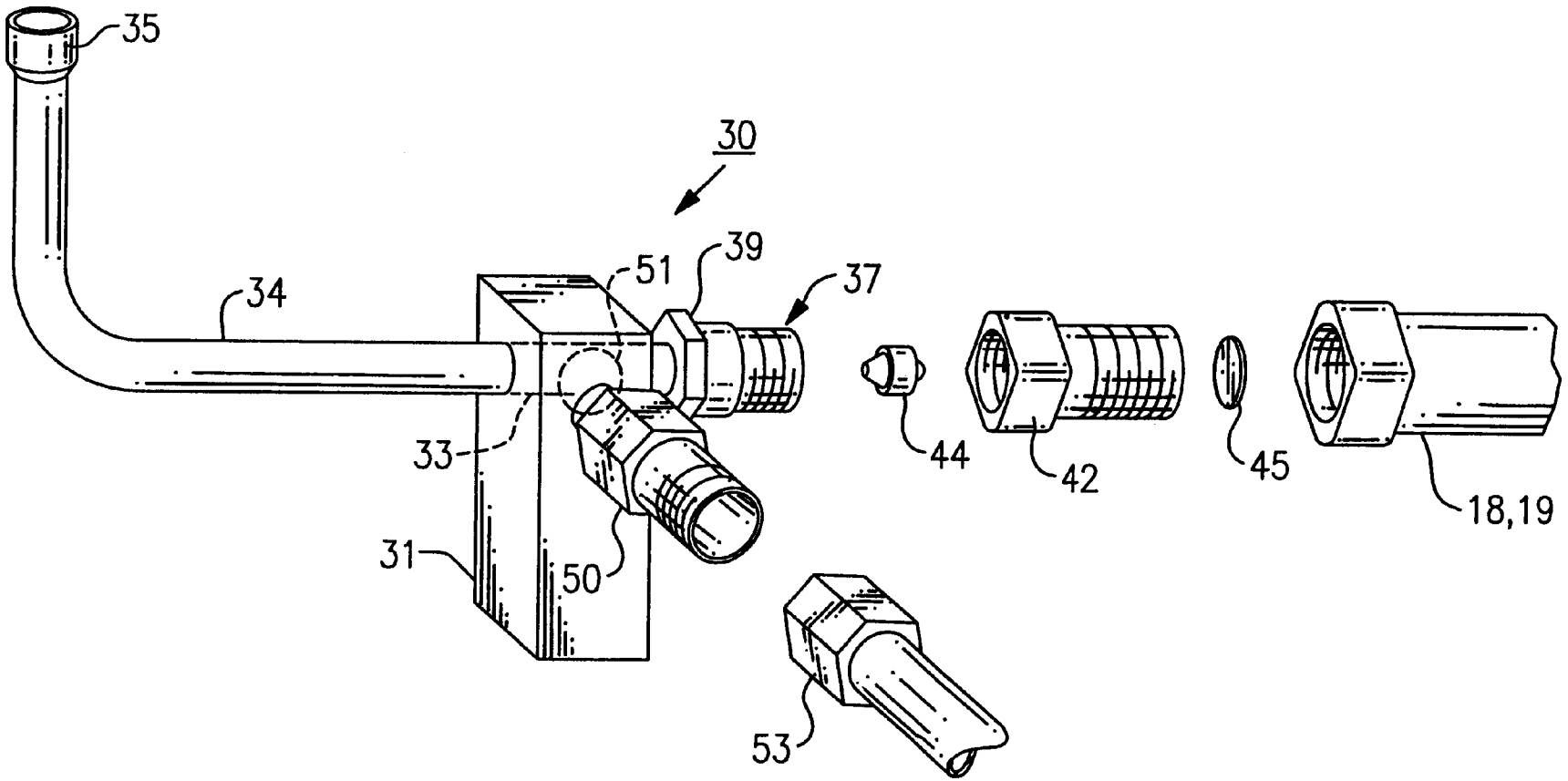
FIG. 2 is an enlarged perspective view of a service unit employed in the air conditioning system illustrated in FIG. 1.

A pair of service units, generally referenced 30, are mounted upon the outdoor section of the system. The construction of the service units is shown in greater detail in FIG. 2. Each unit contains a body member 31 which is fabricated from a square or rectangular piece of common bar stock that is fastened to the outdoor section of the system by any suitable type of fastening means such as threaded fasteners or the like. A main channel 33 is passed through opposing side walls of the body member and a piece of preferably copper tubing 34 is secured as by brazing in one end of the channel. The distal end of the tubing is equipped with a threaded fastener 35. The tubing passes into the indoor section of the system and is attached to a suitable refrigeration line (not shown) located within the section.

A refrigerant line connector 37 is similarly secured in the opposite end of the main channel 33. The connector includes a male fitting 39 that is mounted on a short length of tubing 40 that is passed into the channel and secured in place as by brazing. The male fitting is arranged to threadably mate with a female fitting 42 whose corresponding male fitting (not numbered) is connected to a female fitting of one of the refrigerant lines 18, 19. A floating piston 44 is contained within the connector as shown. A penetratable disc seal 45 is mounted within the female fitting 42. The disc seal is fabricated from a thin piece of metal or any other suitable material that can be penetrated or ruptured as the two fittings are brought together in assembly. When the seal is penetrated or broken, a flow path for refrigerant is established through the service unit. A connecter of the type herein described is commercially available through Eaton Aeroquip Air Conditioning & Refrigeration Division located in New Haven, Ind. and is marketed under the trade name Aeroquip Quick Connect.

A process valve 50 is also mounted upon the body member of the service valve and is placed in fluid flow communication with the main channel by an auxiliary channel 51 passed into a third wall of the body section. The auxiliary channel, like the main channel can be established using a simple drilling or boring operation. The process valve is inserted into the entrance to the auxiliary channel. The process valve is also available through the Eaton Aeroquip Division noted above. The process valve is arranged to coact with an adaptor 53 so that refrigerant can be delivered under pressure into the outdoor unit or removed from the unit if the need arises. The process valve is primarily used to charge the outdoor section with refrigerant in the factory prior to shipment into the field. The valve is opened when the adaptor is mated to the valve and closes automatically when the adaptor is removed. As can be seen, refrigerant is prevented from escaping from the outdoor section by the sealed connector so that this section of the system can be pre-charged prior to shipment into the field.

The two refrigerant lines 18 and 19, in this embodiment of the invention, are connected directly into the indoor coil of the system as illustrated in FIG. 1. The indoor coil of the system may also be pre-charged with refrigerant at a relatively slower pressure than the outdoor section. Connectors 30, such as those described above, are again utilized to connect the indoor coil to the refrigerant line in the field.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A service unit for use in a split air conditioning system having a first section that is connected to at least one other section by a pair of refrigerant lines, said unit including a body member, a main channel passing through said body member, a tube attached to one end of said main channel that is connected to a component within said first section of the air conditioning system, and a connector attached to the opposite end of said channel for removably coupling said main channel to one of the refrigerant lines, said connector containing a seal that is normally closed prior to installation of the first section and which is simultaneously opened when a leak tight joint is formed between the body member and the refrigerant line.

2. The service unit of claim 1 that further includes an auxiliary channel in said body member that passes into said main channel and a process valve mounted in the entrance to said auxiliary channel for charging refrigerant into said first section of the refrigerant system.

3. The service unit of claim 1 wherein said seal is a penetrable disc that is broken or ruptured when the connector is closed.

4. The service unit of claim 3 wherein said connector has a male fitting that is threadable into a female fitting and said seal is broken or ruptured when the male fitting has been threaded into the female fitting sufficiently to form a leak tight joint.

5. The service unit of claim 1 wherein said body member is fabricated from a piece of parallegramic-shaped bar stock.

6. The service valve of claim 5 wherein said main channel is a machined hole passing through opposed sides of said body member.

7. The service valve of claim 6 that wherein said auxiliary channel is a machined hole that passes through a third side of said bar stock member and opens into said main channel.

8. The service unit of claim 1 wherein said first section of the system is an outdoor section that includes a system compressor.

9. Apparatus for assembling a pre-charged first section of an air conditioning system to a second section, said apparatus including a pair of service units mounted in fluid flow communication with said first section whereby refrigerant can flow between the units and said first section, each unit further including a connector for coupling the unit to one of said refrigerant lines so that refrigerant can flow between the line and the first section, said connector further includes a threaded male fitting that mates with a threaded female fitting and wherein one of said fittings is coupled to said unit and the other fitting being connected to said refrigerant line, a seal means contained within said connector that is simultaneously opened when said male fitting is threaded into said female fitting a sufficient distance to establish a leak tight seal between the fittings.

10. The apparatus of claim 9 wherein each service unit further includes a process valve for charging refrigerant into said first section whereby the first section can be pre-charged with refrigerant prior to coupling said service unit to a refrigerant line.

11. The apparatus of claim 9 wherein each service unit includes a body member fabricated from a piece of bar stock having parallel side walls and parallel end walls, said body member further having a main channel passing through two opposed side walls and wherein, a tube is mounted in one end of said main channel and the connector is mounted in the other end of said main channel.

12. The apparatus of claim 11 wherein said body member further includes an auxiliary channel passing inwardly through a third wall of said body and which opens into said main channel and a process valve mounted in the entrance to said auxiliary valve for charging refrigerant into said first section.

* * * * *